United States Patent [19]

Gabathuler et al.

[11] Patent Number: 4,592,260

[45] Date of Patent: Jun. 3, 1986

[54] BAND CUTTING MACHINE

[75] Inventors: Ferdinand Gabathuler, Grabs; Erik G. Nilsson, Werdenberg, both of Switzerland

[73] Assignee: Swegea Maschinen AG, Buchs, Switzerland

[21] Appl. No.: 717,061

[22] Filed: Mar. 28, 1985

[51] Int. Cl.[4] ..... B26D 1/24

[52] U.S. Cl. ..... 83/74; 83/175; 83/187; 83/925 EB

[58] Field of Search ..... 83/175, 72, 74, 178, 83/187, 925 EB

[56] References Cited

U.S. PATENT DOCUMENTS

| | | | |
|---|---|---|---|
| 3,581,614 | 6/1971 | Catallo | 83/187 |
| 3,776,077 | 12/1973 | Letsche | 83/175 X |
| 4,413,575 | 11/1983 | Gazzarrini | 83/187 |

FOREIGN PATENT DOCUMENTS

| | | | |
|---|---|---|---|
| 2932006 | 2/1981 | Fed. Rep. of Germany | 83/175 |

*Primary Examiner*—Donald R. Schran
*Attorney, Agent, or Firm*—Ladas & Parry

[57] ABSTRACT

The frame of the band cutting machine comprises an arm cross consisting of four arms. Each arm supports a fabric feeding roller which is movable back and forth of the arm. The movement of the rollers is carried out by means of threaded spindles extending each through a threaded block supporting a feeding roller. The spindles are interconnected at the center of their arm cross such that a rotating of one spindle by means of e.g. a hand-wheel will lead to a rotating of the other spindles and accordingly a simultaneous shifting of the fabric feeding rollers along the arms. The location of the upper edge of the circular knitted fabric being cut is scanned by a photoelectric apparatus. The circular cutting knives are supported for a translatory adjusting movement in direction of their center axis. The raising and lowering of these cutting knives is controlled by the output signals of the photoelectric apparatus. The cutting knives are raised or lowered in accordance with the scanned position of the upper edge of the circular knitted fabric being cut such that a continuous accurate width of the band or bands, respectively, being cut can be maintained throughout the cutting operation. The circular knitted fabric supporting turntable is mounted at the base of the frame and is driven for rotation by a motor. This turntable supports a bracket. The fabric to be cut is threaded through the bracket. This bracket is rotatable in a horizontal plane relative to the supporting turntable through a limited angle. The angular position of this bracket relative to the turntable, which angular position is determined by the fabric moving therethrough, is scanned.

10 Claims, 9 Drawing Figures

Fig.3
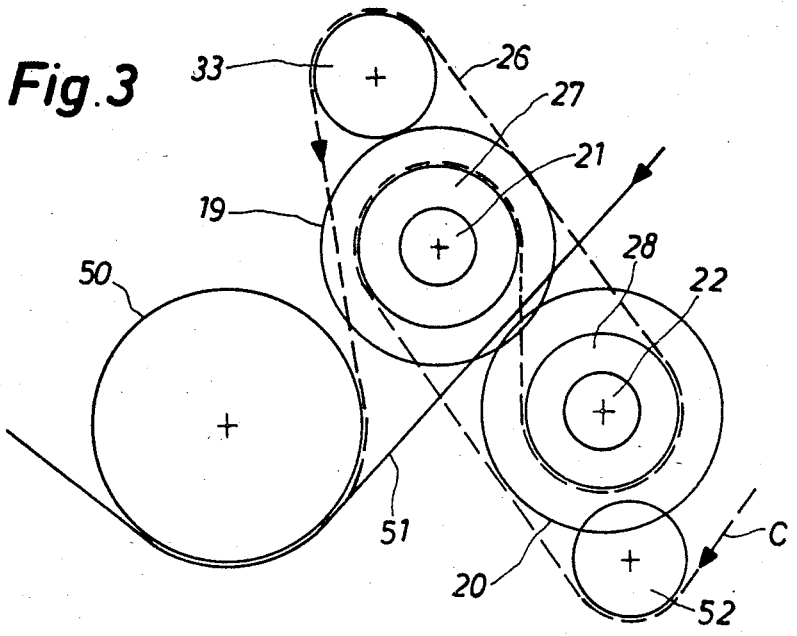
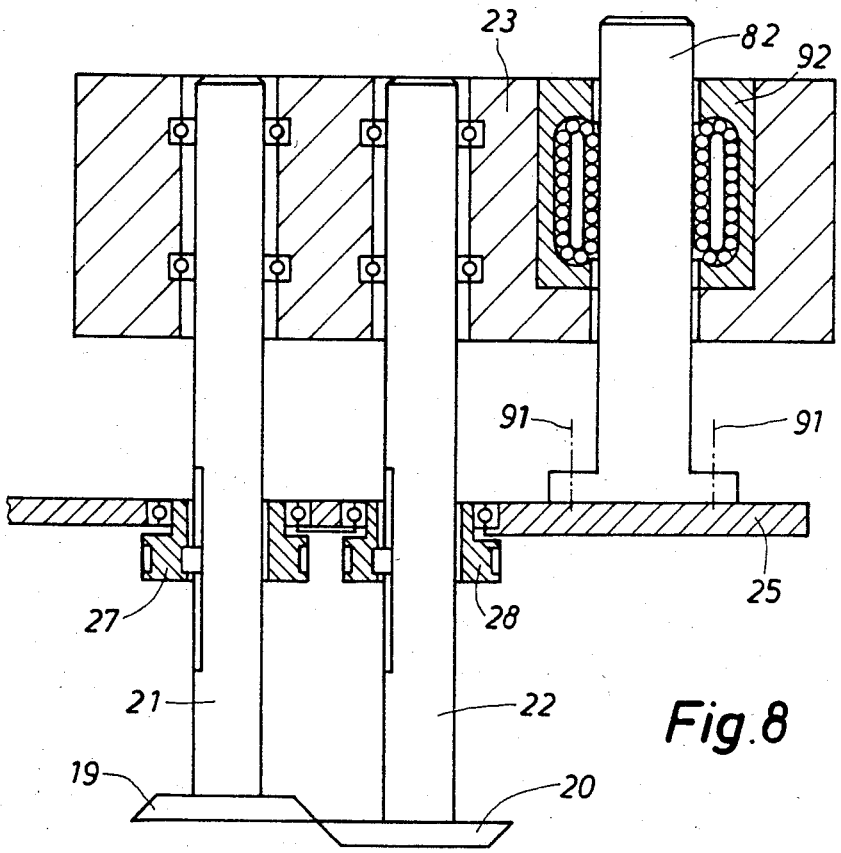
Fig.8

BAND CUTTING MACHINE

BACKGROUND OF THE INVENTION

1. Field of the Invention

The present invention relates to a band cutting machine for cutting a tubular article such to produce at least one band therefrom, which band cutting machine includes a frame; a rotating cutting means supported by the frame and having at least one rotating cutting member intended to cut such tubular article into at least one band and having further a driving means operative to rotate the cutting member; a rotatably mounted supporting turntable intended to support a supply of a folded or rolled tubular article to be cut; a drive motor coupled to the supporting turntable and operative to rotate the turntable at a controlled rotational speed; an article feeding and rotating means operative to continuously feed the tubular article towards the cutting means in a spread out condition by drawing the fabric off the turntable and simultaneously inducing a horizontal rotary movement of the tubular article whereby the tubular article is fed continuously towards the cutting means.

Such tubular article may be a hoselike article of an extruded plastic material or an elastomeric material such as rubber, may be a woven textile article or a knitted textile material such as a circular knitted fabric.

The cutting means may include a band saw apparatus, a crush-knife apparatus or a cutting knife apparatus having at least one pair of cooperating circular rotating knives forming the cutting members. Accordingly, the cutting member supporting shafts may be knife supporting shafts.

2. Description of the Prior Art

Such band cutting machines are commonly employed to cut from a tubular article a band or ribbon, respectively, or to cut simultaneously a plurality of bands from such tubular article. Such tubular article, e.g. a circular knitted fabric is an extremely limp article which may be more or less elastic. Moreover, such articles may indeed be of an elastic material which is cut into elastic bands by band cutting machines.

Quite obviously the width of the bands cut by band cutting machines should be continuously equal throughout the entire length of such band. This task is sought to be accomplished by means of a variety of structural designs of such band cutting machines. It has been, however, practically impossible to achieve bands having a continuous equal width within fractions of inches. The reason for this difficulty is on the one hand the structure of the tubular article being cut. As mentioned above it is a rather limp and partly or entirely elastic article. On the other hand the band cutting machine is a combination of various functional units, namely in general the turntable on which such tubular article is initially placed in a folded or rolled condition, the unit which spreads the tubular article out to a more or less circular or polygonal state combined with a drive member feeding the tubular article towards a cutting means, e.g. the knives by inducing a rotary as well as a longitudinal movement on the tubular article and finally the cutting means itself. It is now obviously quite important that the forces exerted on the tubular article should be as little as possible to avoid any distortion or deformation, respectively, thereof, which would lead to nonuniform widths of the band cut and, furthermore, the various units should cooperate closely with each other in that they are closely controlled.

The width of a band or ribbon, respectively, which is cut by the circular knives is known to have been controlled in that a feeling means scanned the upper rim or edge of the tubular article, which feeling means controlled a unit responsible for the longitudinal feeding of the tubular article such that an increase or a decrease of the feeding motion was governed by such feeler and the cutting members of the cutting means were supported in fixed bearings. Since a certain time lag prevails between the determining of a given position of the upper edge of the tubular article and that area of the article contacting the cutting member, errors regarding the cut width of the band have prevailed in the commonly known band cutting machines.

SUMMARY OF THE INVENTION

Hence, it is a general object of the invention to provide a band cutting machine for cutting a tubular article having cutting means comprising at least one cutting member supporting shaft supported for rotation around its center axis and for a simultaneous controlled translatory longitudinal movement in direction of its center axis relative to at least one section of the frame; the cutting means comprising further a control means for controlling the translatory position of the cutting member supporting shaft; having further a feeler means operative to scan the position of the upper edge of the rotating tubular article being fed towards at least one of the rotating cutting members and to transmit a control signal indicative of the position of the upper edge of the tubular article to the cutting member supporting shaft position control means; whereby the translatory position of at least one of the cutting members relative to at least one section of the frame is continuously adjusted in accordance with the scanned position of the upper edge of the tubular article such to maintain a continuously and accurately determined width of a respective band being cut; the rotating article supporting turntable of the band cutting machine comprising a tubular article position feeler means mounted thereupon and operative to determine the angular position of the article being rotatively drawn off the turntable relative to the angular position of the turntable and to transmit a control signal indicative of said relative angular position; whereby upon a first relative angular position of the tubular article being drawn off the turntable relative to the turntable in a first sense of rotation exceeding a first preset value and thus indicative of the rotating tubular article leading the turntable, the rotational speed of the turntable relative to the rotational speed of the rotary movement of the tubular article is increased and upon a second relative angular position of said tubular article relative to the turntable in a second, opposite sense of rotation exceeding a second preset value and thus indicative of the rotating tubular article trailing the turntable, the rotational speed of the turntable relative to the speed of the rotary movement of the tubular article is decreased.

The rotational speed of the turntable relative to the rotational speed of the rotary movement of the tubular article may be increased either by increasing the rpm of the turntable drive motor while keeping the rpm of the tubular article constant, or then by maintaining the rpm of the turntable drive motor constant while decreasing the rpm of the tubular fabric. The decreasing of the rpm of the turntable relative to the rpm of the tubular fabric may likewise be obtained by changing the rpm of the turntable motor or of the tubular fabric while keeping the rpm of the corresponding other rotating member constant.

A further object is to provide a band cutting machine, wherein at least one of the cutting member supporting shafts is rotatably supported in a carrier block which is supported and guided by a guiding means mounted to at least one section of the frame for said movement in the axial direction of at least one of the cutting member supporting shafts, wherein the cutting member supporting shaft position control means comprises a drive motor mounted to at least one of the sections of the frame and comprises further a carrier block positioning means driven by the drive motor and operatively connected to the carrier block, and wherein the feeler means comprises a photoelectric device connected electrically to the drive motor for transmitting said control signal indicative of the position the upper edge of the tubular article thereto, whereby the motor is actuated if said position deviates from a preset value.

BRIEF DESCRIPTION OF THE DRAWINGS

The invention will be better understood and objects other than those set forth above will become apparent when consideration is given to the following detailed description thereof. Such description makes reference to the annexed drawings, wherein:

FIG. 3 is a view similar to the view of FIG. 2 of the detail B thereof on a somewhat enlarged scale;

FIG. 8 is a sectional view taken along line VIII—VIII of FIG. 6; and

DESCRIPTION OF THE PREFERRED EMBODIMENT

Figure 1:
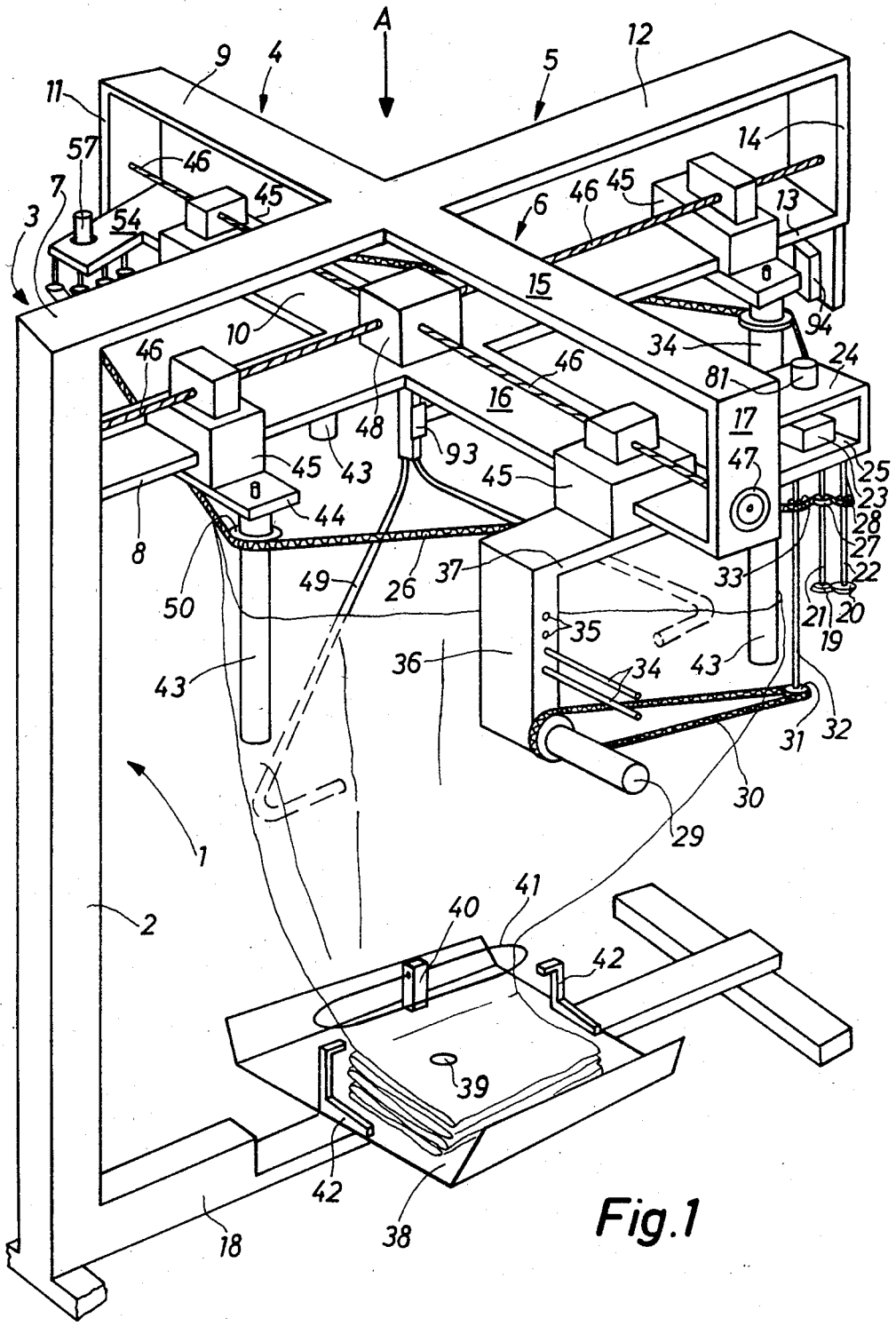
FIG. 1 is a schematic perspective view of a band cutting machine designed in accordance with the present invention.

FIG. 1 illustrates a perspective, somewhat schematic view of a band cutting machine. It comprises a frame identified generally by the reference numeral 1. This frame consists mainly of an upright column 2 of a square cross section, which column supports four arms identified generally by the reference numerals 3, 4, 5 and 6, which arms are arranged in an arm cross configuration. These arms 3, 4, 5 and 6 consist of two strips. Arm 3 has an upper strip 7 and a lower strip 8 rigidly connected to the upright column 2. All parts forming the frame are of metal and thus welded together.

Arm 4 consists of upper strip 9 and lower strip 10 interconnected at their ends by a vertical strip 11. Similarly, arm 5 consists of an upper strip 12, a lower strip 13 interconnected by a vertical strip 14 and finally, arm 6 consists of an upper strip 15 and a lower strip 16 interconnected by a vertical strip 17. The upright column 2 is welded to a base 18 which supports the entire band cutting machine on the ground.

Frame 1 supports a rotating cutting means. Such cutting means may include a band saw apparatus, a crush-knife apparatus or a cutting knife apparatus. In case of a band saw apparatus one or more cutting members, i.e. band saws, may be present such that one or simultaneously a plurality of bands can be cut from one tubular article. In case of a crush-knife or a cutting knife apparatus one or a plurality of cooperating pairs of rotating cutting members may be present, such that likewise one or a plurality of bands may be simultaneously cut. In this embodiment the cutting members are illustrated as one pair of circular cutting knives 19, 20. Although FIG. 1 illustrates only one pair of cutting knives 19, 20, it is understood that as is well known in the art and explained above a plurality of cutting knife pairs may be present for cutting simultaneously a plurality of bands from e.g. one circular knitted fabric. The circular cutting knife 19 is supported by a knife supporting shaft 21 and the circular cutting knife 20 by a knife supporting shaft 22. As will be explained in detail later on, these knife supporting shafts 21, 22 are guided and arranged for a controlled translatory longitudinal movement in the direction of their center axis.

The knife supporting shafts 21, 22 of this embodiment are supported basically in a carrier block 23 located between an upper plate 24 and a lower plate 25, the mounting of which being explained further below. The knife supporting shafts 21, 22 are driven by an endless belt 26 and via drive pulleys 27, 28.

The band or bands, respectively, which have been cut from the circular knitted fabric may be received by and stored in any conventional means or container, respectively. In the illustrated embodiment the band or bands are received and reeled by a band take-up roller 29. This band take-up roller is driven by a belt 30, driven in turn by a belt pulley 31 mounted to a shaft 32 carrying a guide belt pulley 33 which is driven by the endless belt 26. The cut band or bands, respectively, are guided over stub shafts 34 onto the band take-up roller 29. The number of stub shafts depends on the number of simultaneously cut bands. Two stub shafts 34 are designed in FIG. 1, whereby further stub shaft supporting holes 35 are indicated for use in case of a larger number of bands being cut. The band take-up roller 29 and the stub shafts 34 are supported by a vertical arm 36 welded to a horizontal axis 37.

The base 18 of frame 1 supports a rotatably mounted supporting turntable 38. This turntable 38 supports a supply of the circular knitted fabric to be cut into bands. As is well known in the art, the circular knitted fabric is placed in a zigzag like folded condition directly on the turntable or may be present in a rolled condition around a supporting shaft which is supported by a small stand on the turntable 38. Because the circular knitted fabric is drawn off the turntable 38 such that it carries out a rotational movement necessary for the feeding of the fabric towards the knives, the turntable 38 rotates during operation of the band cutting machine. The turntable 38 of this invention is rotated by means of a drive motor indicated in FIG. 1 schematicially by reference numeral 39. This drive motor 39 rotates the turntable 38 at a controlled rotational speed as will be explained later on.

The turntable 38 supports, furthermore, a stand 40. This stand 40 supports a bracket 41 which is part of a fabric position feeler means. This bracket 41 is rotatably supported by the stand 40 such that it may carry out a limited, angular movement in a plane extending parallel to the plane of rotation described by the rotating turntable 38. The two L-shaped angle pieces 42 mounted on the turntable 38 depict schematically the supports for a rolled circular knitted fabric to be cut. Such knitted fabric, independently of it being present in a zigzag shaped folded condition or in a rolled condition, is folded flat such that two plies lying on top of each other are present. This fabric is threaded in mentioned folded condition through the bracket 41 and led to the fabric feeding and rotating means which now will be described.

The fabric feeding and rotating means comprises a plurality, in this embodiment, four fabric feeding rollers 43 having a jacket which operates to feed the knitted fabric towards the cutting knives 19, 20 by imposing a rotating movement on the fabric and at the same time a drawing off movement feeding such fabric from the turntable 38 upwards. The four fabric feeding rollers 43 are of identical design and supported identically such that the following description refers to the feeding roller 43 located at the arm 3, i.e. the arm which is directly welded to the upright column 2.

The feeding roller 43 is rotatably supported in a plate 44 which is part of a sliding block 45. This sliding block 45 is slidable along the lower strip 8 of arm 3. The movement of the sliding block 45 along the lower strip 8, i.e. of the arm 3, is induced by means of a threaded spindle threadingly received in the upper part of the sliding block 45. The threaded spindles 46 are driven for rotation by means of a handwheel 47 mounted to the threaded spindle 46 which is supported at one end in the vertical strip 17 interconnecting the upper 15 and lower strip 16 of arm 6. In place of this handwheel there may be provided a small motor for rotating the spindle 46. The four spindles are interconnected by means of a gearing located in a gearbox 48 mounted in the center of the arm cross 3, 4, 5, 6. The spindles are provided with such a thread and the gear wheels in the gearbox 48 are arranged such that upon rotating the handwheel 47 all sliding blocks 45 are moved simultaneously against the center of the arm cross, when the handwheel 47 is turned in the opposite sense away from the center of the arm cross towards the respective distal ends of the arms 3, 4, 5, 6.

It is generally known, that the circular knitted fabric which is being cut into a band or bands, respectively, is guided into a spread open shape allowing the cutting thereof by the respective cutting knives. These four feeding rollers 43 hold now the circular knitted fabric in such spread open condition. Bracket 49 is rotationally supported at the arm cross center and acts to keep the fabric in a laterally spread out shape corresponding roughly to the contour of the inner circumference of the bracket 41 mounted on the turntable 38. Circular knitted fabrics are produced in a variety of diameters. By sliding these feeding rollers 43 back and forth along the arms 3, 4, 5, 6 their mutual distance can be infinitesimally adjusted such to suit any diameter of a respective circular knitted fabric to be cut by simply rotating handwheel 47. This feature allows also a selecting of the most favorable tension of the circular knitted fabric held by the feeding rollers 43 in a spread out condition. It has been mentioned earlier that the tension present in a circular knitted fabric may greatly influence the accuracy of the width of the band being cut therefrom. Accordingly, it is possible to select a minimal tension necessary for feeding the circular knitted fabric merely by operating the handwheel 47 and thus sliding the feeding rollers 43 back and forth of the arms 3, 4, 5, 6.

Considering now the structure around the feeding roller 43 located on arm 6 provided with the handwheel 47 it can be seen, that the horizontal arm 37 supporting via the vertical arm 36 the band take-up roller 29 and the stub shafts 34 is mounted directly to the respective sliding block 45. The horizontal arm 37 is accordingly an opposite extension of the plate 44 supporting the corresponding feeding roller 43. At the other side of this sliding block 45 the lower plate 25 supporting the carrier block 23 for the knife supporting shafts 21, 22 forms also an extension of this plate 44.

Accordingly, when the sliding block 45 allocated to this arm 6 is moved there along, the band take-up roller 29 as well as the knife supporting shafts 21, 22 and accordingly the cutting knives 19, 20 are also moved such that conclusively the geometrical distances between all these parts of the band cutting machine do not change upon an adjusting of the fabric feeding rollers 43 to a respective size of a circular knitted fabric.

Figure 2:
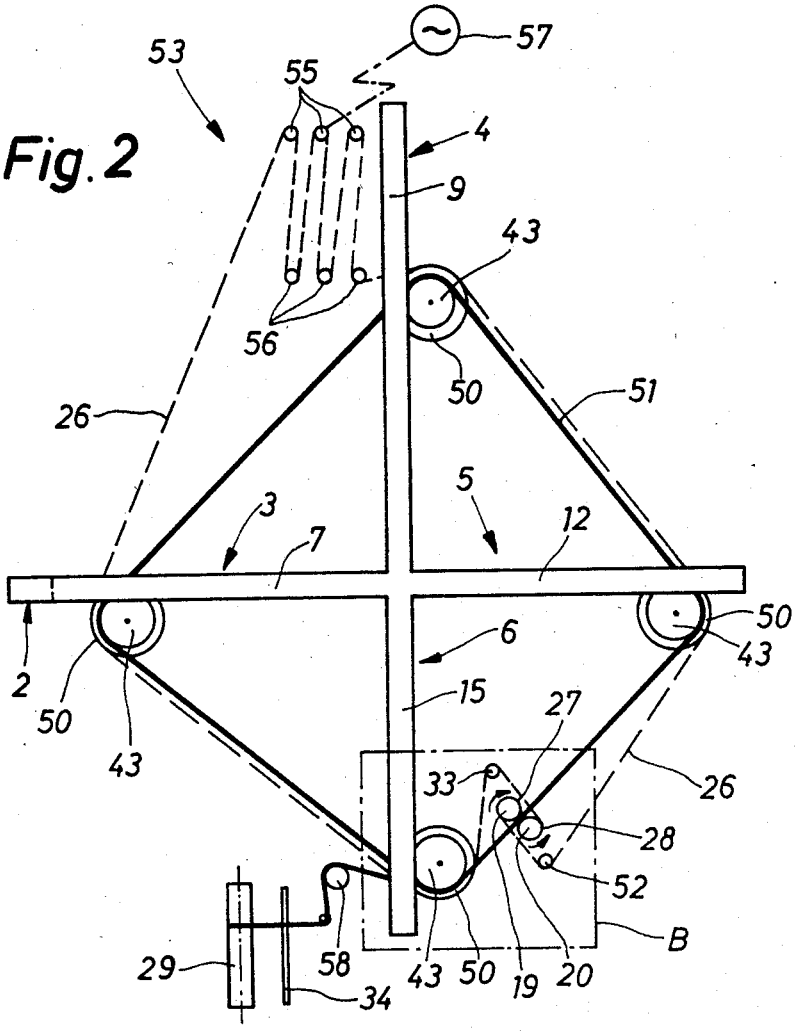
FIG. 2 is a schematic view in the direction of the arrow A of the band cutting machine shown in FIG. 1 and illustrating the positions of the feeding rollers on the arms and the run of the circular knitted fabric being cut and of the run of the drive belt for the feeding rollers.

The endless belt for driving the feeding rollers 43 is identified by reference numeral 26. Attention is now additionally drawn to FIGS. 2 and 3. Each feeding roller 43 is provided with a belt pulley 50. The endless belt 26 which in this preferred embodiment is of a smooth (not toothed) design runs around the respective belt pulleys 50 of the feeding rollers 43 for rotating the feeding rollers. The endless belt 26 is illustrated in FIGS. 2 and 3 by a broken line and the knitted fabric is illustrated in FIGS. 2 and 3 by a solid line. The endless belt 26 running in the direction identified by the arrow C in FIG. 3 loops around a guide pulley 52 (not illustrated in FIG. 1), thereafter around the drive pulley 27 of the knife supporting shaft 21, thence around the drive pulley 28 of the other knife supporting shaft 22. By means of this operating arrangement of the endless belt 26 the cutting knives 19, 20 rotate in an opposite sense of direction commensurate with the cutting operation of the circular knitted fabric.

The endless belt 26 leaving drive pulley 28 of the knife supporting shaft 22 is guided around a further guide pulley identified by the reference numeral 33 and referred to earlier and is looped thereafter around belt pulley 50 of the fabric feeding roller 43 located at the handwheel 47 supporting end of arm 6. This arrangement in turn determines the sense of rotation of the circular knitted fabric being fed towards the cutting knives 19, 20.

As mentioned earlier, the mutual distances between the structural members at this area of the band cutting machine remain unaltered when adjusting the distances of the feeding rollers 43 in accordance with a prevailing fabric diameter.

It is obvious, however, that the total operative length of the endless belt 26 must correspond to the distances of the various drive pulleys, specifically the belt pulleys 50, upon their translatory movement along the arms. To this end a belt length storage arrangement 53 (see FIG. 2) is located at the end of arm 4. This belt length storage arrangement 53 is supported by a plate 54 (see FIG. 1)

mounted to the lower strip 10 of arm 4. This belt length storage arrangement 53 is provided with a set of fixed pulleys 55 and a set of movable pulleys 56 enabling a taking up of any excessive length of the endless belt 26. Such belt length storage arrangement is generally known and, thus, will not be described any further in detail. It is, however, to be noted that the drive motor 57 drives one or several of the fixed pulleys 55 (in this embodiment as illustrated in FIG. 2 it is the middle pulley of the three fixed pulleys 55 illustrated) and accordingly the endless belt 26, the fabric feeding rollers 43, the cutting knives 19, 20 as well as the band take-up roller 29 are driven by the drive motor 57. For sake of good order it must be mentioned that reference numeral 58 in FIG. 2 identifies a guide member, for instance, a roller for guiding the cut band towards the stub shaft 34 and the band take-up roller 29.

Figure 5:
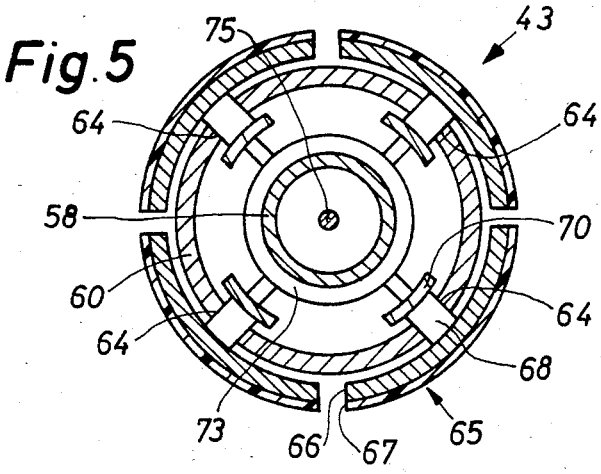
FIG. 5 is a view of a section taken along line IV—IV of FIG. 4.
Figure 4:
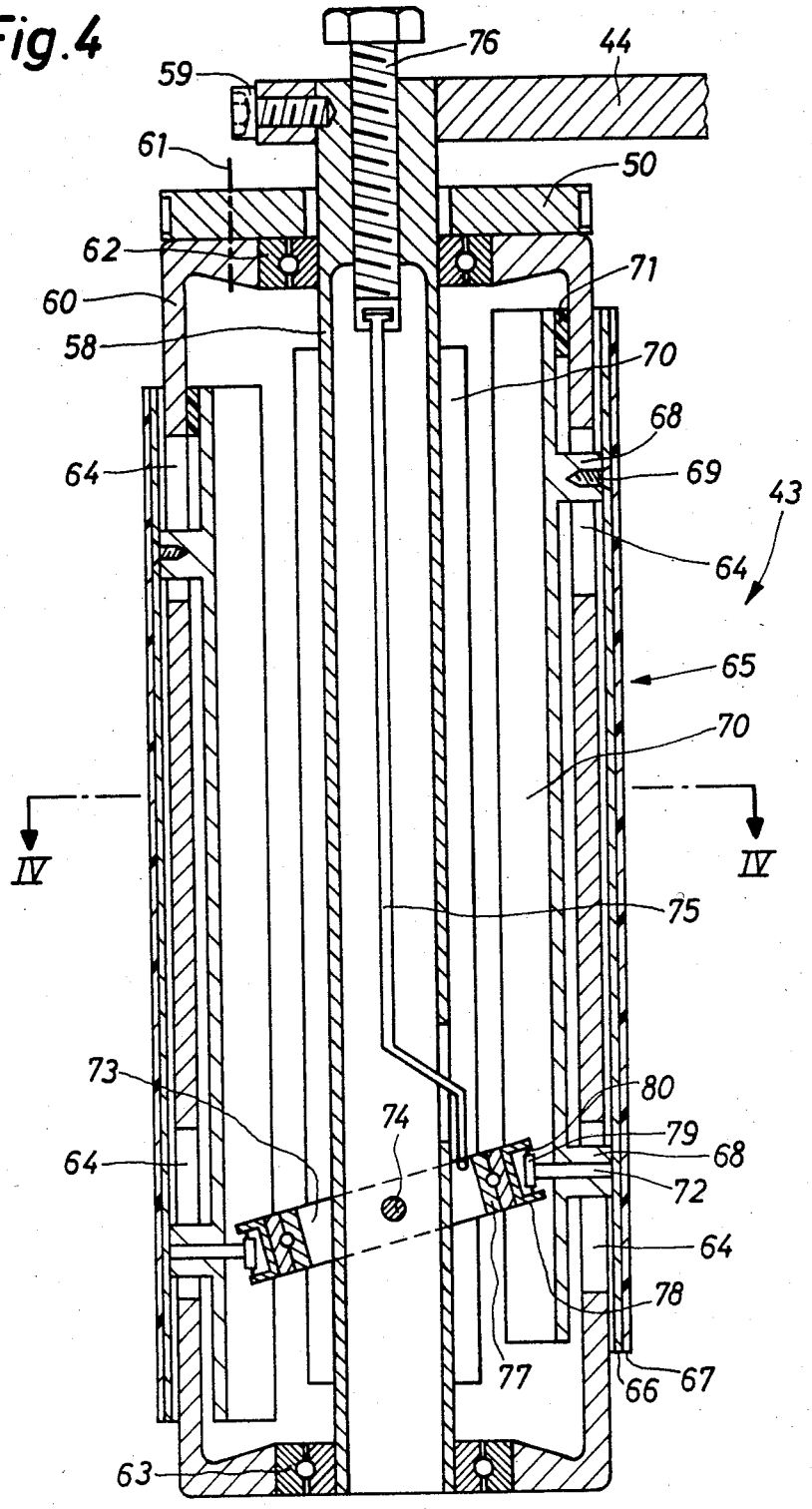
FIG. 4 is a view of a longitudinal section of a feeding roller.

Reference is made now to FIGS. 4 and 5 illustrating an embodiment of the fabric feeding rollers 43.

As mentioned earlier, each fabric feeding roller 43 is suspended from a plate 44 (see FIG. 1) of a sliding block 45 and is driven by means of a belt pulley 50.

The fabric feeding roller 43 comprises a stationary central hollow shaft 58. This hollow shaft 58 is mounted at its upper end by means of a mounting screw 59 to the supporting plate 44 and accordingly to the corresponding sliding block 45. A rotatable hollow cylinder 60 extends coaxially to the central hollow shaft 58. This hollow cylinder 60 is connected to the drive pulley 50 by a means not particularly shown, for instance, by screws 61 represented in FIG. 4 by their central line. Accordingly, the hollow cylinder 60 is driven to rotate by the endless belt 26. The hollow cylinder 60 supports itself on the stationary hollow shaft 58 by an upper ball bearing 62 and a lower ball bearing 63.

The hollow cylinder 60 comprises eight guiding slots 64. Four slots each are arranged at an equiangular distance in the vicinity of the upper end and lower end, respectively, of the hollow cylinder 60. The hollow cylinder 60 is surrounded by shell shaped fabric feeding segments 65 arranged at the circumference of the cylinder 60. Each fabric feeding segment 65 comprises an inner supporting member 66 made, for instance, of metal, although it also may be manufactured of a plastics material, which supporting member 66 is covered at its outside with a friction layer 67. This friction layer 67 may be a textile article, may be an elastomer, rubber article etc. and operating as actual feeding member of the circular knitted fabric. The structure of this friction layer 67 may be of any known kind having a surface friction which is large enough to hold and transport the circular knitted fabric. This friction layer 67 may, for instance, be glued to the supporting member 66.

Each supporting member 66 is mounted via a guiding block 68 and a screw type connector 69 onto a counter segment 70 located at the inner wall of the hollow cylinder 60 and guided thereagainst by means of a sliding guide piece 71. The guiding slots 64 extend in longitudinal direction in the jacket of the rotatable hollow cylinder 60 and accordingly guide the guiding blocks 68 for a movement in direction of the generatrix of the cylinder in a reciprocating fashion.

Accordingly, the four fabric feeding segments 65 can move in a phase displaced condition reciprocatingly in the longitudinal, axial direction of the rotatable hollow cylinder 60.

The lower guiding block 68 is penetrated by a guide pin member 72 extending through the respective counter segment 70 into within the hollow cylinder.

The stationary hollow shaft 58 carries an inclined annular bearing member 73 surrounding the stationary central hollow shaft 58. This bearing member 73 is supported by the hollow shaft 58 via a pin 74 such that the inclination of this bearing member 73 can be altered. In order to allow such changing of the inclination of the annular bearing member 73 a control rod 75 is hingedly connected to the bearing member 73. At the upper end of the central hollow shaft 58 there is provided a set screw 76. This set screw is threaded into the upper end of the hollow shaft 58. The lower end of the set screw 76 is engaged by the control rod 75 such that the screw 76 can be rotated relative to the control rod 75. By means of rotating the screw 76 the control rod may be raised or lowered somewhat and since it is eccentrically mounted to the annular bearing member 73 said longitudinal movement of the control rod 75 will alter the inclination of the bearing member 73.

The annular bearing member 73 is provided with a ball bearing 77 and this ball bearing 77 is surrounded in turn by a so-called outer race 78. Each guide pin member 72 is provided with a head 79 guided via antifriction members 80 in mentioned outer race 78.

Accordingly, the operation of each fabric feeding roller 43 proceeds as follows. Driven by the endless belt 26 and the belt pulley 50 the rotatable hollow cylinder 60 rotates around the stationary central hollow shaft 58. The inclined annular bearing member 73 is also stationary. Accordingly, the guide pin members 72 of the shell shaped fabric feeding segments 65 rotate in the outer race 78 around the stationary hollow shaft 58. Due to the inclination of the entire inclined annular bearing member 73 these guiding pin members 72 reciprocate in longitudinal direction relative to the stationary shaft 58. Accordingly, each fabric feeding segment 65 follows a sinus-wave shaped path during its rotational movement around the stationary shaft 58.

The fabric feeding rollers (see hereto FIG. 1) are arranged now such that the fabric feeding segments 65 contact the circular knitted fabric being transported only during their rotating upwards movement corresponding to the rising branch of the sinus-wave shaped path followed by the feeding segments 65. Relative to the band cutting machine this rising branch of the sinus-wave shaped path faces towards the outside and the downwards path section faces the inside of the entire band cutting machine, because the circular knitted fabric contacts the feeding rollers obviously only at an outer section of their circumference. The rotating of these fabric segments combined with the upwards feeding movement imparts now a rotary as well as an upwards feeding movement onto the circular knitted fabric to be cut. It is now obvious, that the inclination of the inclined annular bearing member 73 may be altered by operating the head screw 76 such that the feed can be increased or decreased depending on the prevailing conditions, for instance, a width of a respective band or of respective bands to be cut.

It shall be noted that also other means may be employed to reciprocate the feeding segments 65 as well as to adjust the length of the stroke of such reciprocating movement, above being and described as preferred embodiment only.

Figure 6:
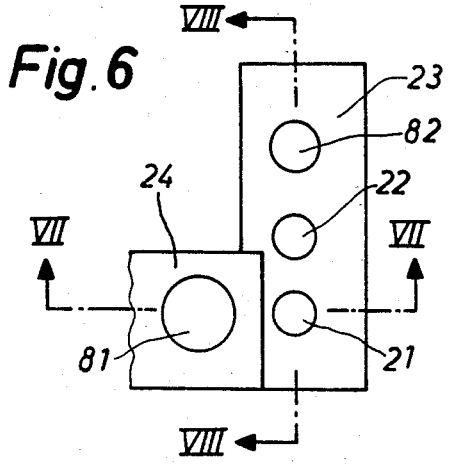
FIG. 6 is a simplified top view showing the relative locations of the cutting knife supporting shafts, the driving means for the translatory movement and the guiding means of the carrier block.
Figure 7:
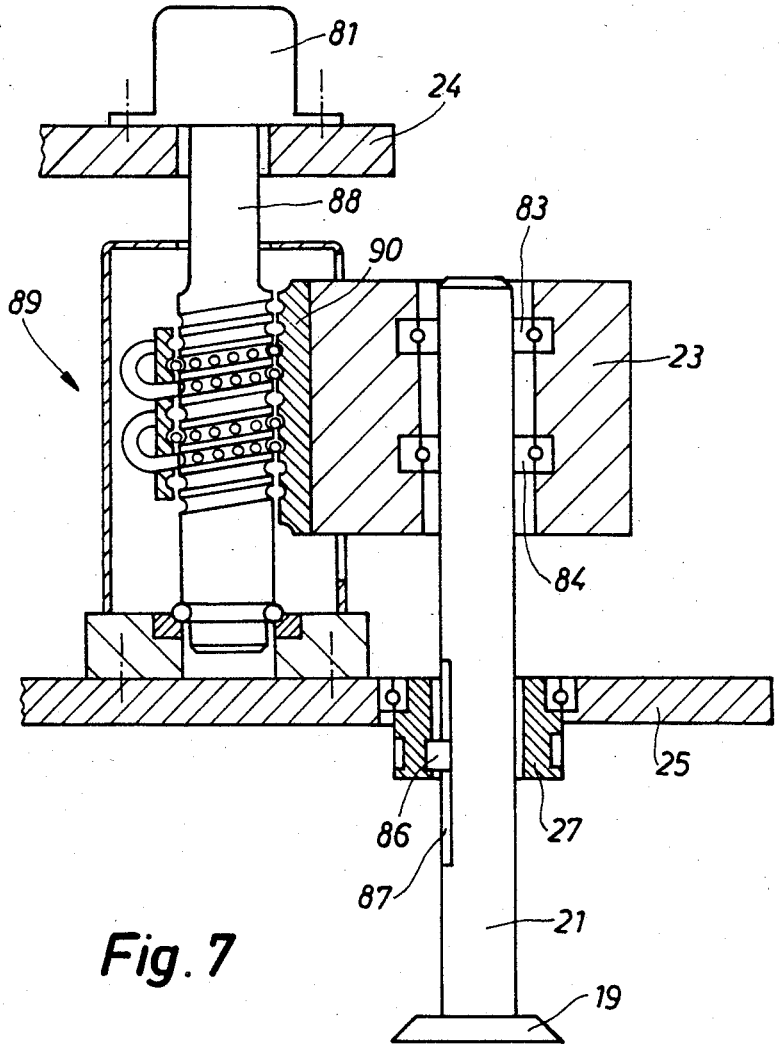
FIG. 7 is a sectional view taken along lines VII—VII of FIG. 6.

Reference is made now to FIGS. 6, 7 and 8 illustrating the cutting means of the band cutting machine of the present invention. FIG. 6 is to illustrate schematically the respective locations of the main members of the cutting means. The reference numerals 21 and 22 of FIG. 6 illustrate the position of the shafts of the cutting members in the carrier block 23. Reference numeral 81 depicts a drive motor (see also FIG. 1) flanged onto the upper plate 24 extending at least partly over the carrier block 23. A guiding means comprises an upright shaft 82 mounted as shown in FIG. 8 onto the lower plate 25. Although the drive motor 81 is shown as a directly driving motor or possibly as geared motor, it may, however, also be provided with a small belt drive.

An important feature of this invention is that the rotary cutting knives are controlled when supported for a movement in axial direction of their shafts. Referring now to FIG. 7 there is illustrated a cutting knife 19 mounted to its supporting shaft 21. The supporting shaft 21 in turn is supported by means of ball bearings 83 and 84 in the carrier block 23, which carrier block 23 can be moved upwards and downwards as will be described hereinafter. The cutting knife 19 moves accordingly together with the carrier block 23 upwards and downwards. The drive pulley 27 for this cutting knife 19 remains however axially fixed but keeps rotating during the upwards and downwards movement of the knife supporting shaft 21 including the cutting knife 19. This drive pulley 27 is supported by means of a ball bearing in the lower plate 25 (see hereto FIG. 1). The drive pulley 27 is provided with a key engaging into a keyway extending longitudinally of the shaft 21. Accordingly the shaft 21 will remain in driving engagement with the drive pulley 27 at any relative axial position thereto. Quite obviously a further embodiment may foresee the inner circumference of the drive pulley 27 and the outer circumference of the shaft 21 having teeth extending in direction of the common center axis of these two members.

The drive motor 81 is coupled to the shaft 88 of a worm ball bearing indicated generally by reference numeral 89. The nut member 90 of the worm ball bearing 89 is fixedly mounted to the carrier block 23. It must be said that this worm and nut type gear device may consist also merely of a threaded spindle extending from shaft 88 and an accordingly arranged nut member 90 having an inner thread. At any rate it is now obvious that upon a rotating of the drive motor 81 the carrier block 23 and accordingly the cutting knife 19 can be moved upwards and downwards in axial direction.

In FIG. 8 both cutting knives 19, 20 and both knife supporting shafts 21, 22 are illustrated, their arrangement and support being such as described above with reference to FIG. 7. The guiding means for the carrier block 23 comprises firstly an upright shaft 82 made, for instance, of stainless steel, which upright shaft 82 is fixedly mounted to the plate 25 by means of not in detail illustrated screw type connectors 91. A sliding ball bearing 92 is housed in the carrier block 23 and supports the carrier block 23 against the upright shaft 82 and guides accordingly the carrier block 23 for longitudinal movement along the shaft 82. Accordingly, the carrier block 23 is mainly supported in a cantilever fashion by the sliding ball bearing 92 on the upright shaft 82 such that the minimum of bearing forces prevail at the worm ball bearing 89 allowing an operation with extremely little friction thereat.

Figure 9:
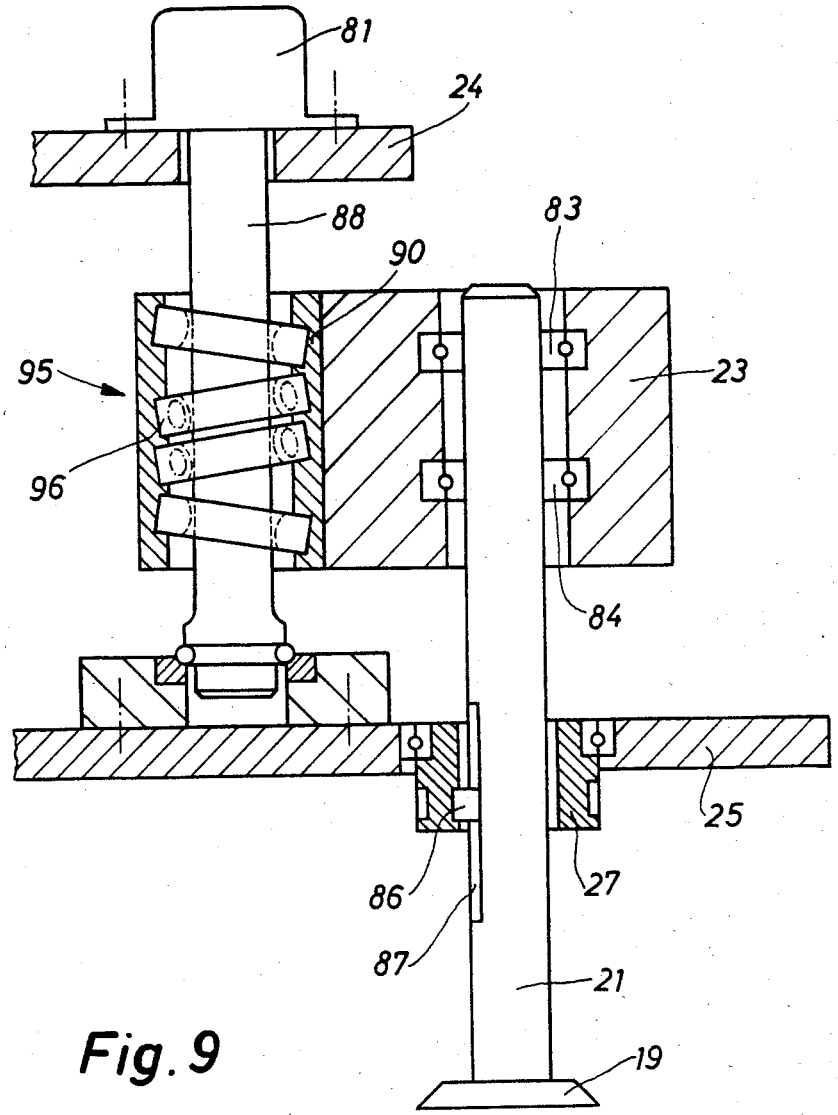
FIG. 9 is a sectional view similar to FIG. 7 of a further embodiment.

FIG. 9 corresponds to FIG. 7 with the exception that in this embodiment the carrier block 23 is mounted to a linear drive unit 95 having a frictionless nut. The shaft 88 driven driven by the drive motor 81 extends through a number of ball bearing units 96, of which three are illustrated, which ball bearing units are supported at their outer races in the nut member 90. The ball bearing units 96 extend at an oblique angle relative to the shaft 88 such that upon rotation of the shaft 88 the nut member 90 and accordingly the carrier block 23 are translatorily moved parallel to the shaft 88. Such linear drive units comprising a shaft, obliquely arranged ball bearing units and nut member 90 ar sold by Optiplan AG, Lucerne, Switzerland and are disclosed in Swiss Patent Specification No. 622 324.

This above described embodiment illustrates a design, according to which the cutting member shafts 21, 22 are reciprocatable relative to the entire frame of the band cutting machine. Other embodiments contemplate a reciprocating movement of the shafts 21, 22 relative to a section only of the frame of the band cutting machine. Accordingly, the shafts 21, 22 could be supported by bearings in plate 25 (see FIG. 8) (or in plate 24) such that no relative axial movements of the shafts relative to this plate are possible. The plate may then be fixedly mounted to one of the upper strips 7, 9, 12, 15 (here obviously 15) of the arms 3, 4, 5, 6 (See hereto FIG. 1). In place of the vertical strips 11, 14, 17 and the upper section of the upright volumn 2 a telescoping structure or a structure similar to the sliding ball bearing structure 92 (FIG. 8) may be arranged. Accordingly, the supporting shafts of such embodiment will be movable relative to a section only of the frame 1. When the shafts must be translatorily moved in direction of their center axis, the entire arm cross consisting of the strips 7, 9, 12, 15 will be moved and thus will move the shafts in the requisite direction. In such case the drive motor 81 will be mounted to an unmovable section of frame 1.

The operation of the illustrated embodiment of the band cutting machine of the invention is as follows. Initially, the circular knitted fabric to be cut into one or several bands is placed on the supporting turntable 38. The leading edge of this circular knitted fabric in its folded together condition is threaded through bracket 41 mounted on the turntable 38 and drawn upwards around the bracket 49 and drawn thence apart such that the fabric can encase the four fabric feeding rollers 43. By operating the handwheel 47 the position of the fabric feeding rollers 43 is adjusted such that these feeding rollers 43 safely rotate and support the circular fabric. The area of the upper edge of the fabric is placed between the two rotary cutting knives 19 and 20 and the initial cut made such that now the band cutting machine can be put into operation. This is done by simultaneously energizing drive motor 57 for the endless belt 26 and the drive motor 39 for the rotatably mounted supporting turntable 38. The sense of rotation of the turntable 38 corresponds obviously to the sense of rotation of the fabric feeding rollers 43 driven by the endless belt 26. The rotational speed of the supporting turntable 38 must correspond now to the rotational speed of the circular knitted fabric generated by the rotating fabric feeding rollers 43. If these two rotational speeds do not correspond to each other, the circular knitted fabric being drawn off the turntable will twist sooner or later.

Now, the circular knitted fabric is threaded through the bracket 41 on the turntable 38, which fabric is still in its folded condition at this location. As mentioned earlier, the bracket 41 is mounted in the stand 40 such, that it can rotate through a limited angle in a plane extending parallel to the plane defined by said bottom plate of the turntable 38. If now the speed of rotation imparted on the fabric by the fabric feeding rollers 43 is larger or smaller than the rotational speed of the turntable 38, a twisting motion is initiated in the circular fabric. This twisting motion is now exerted also on the bracket 41 which will rotate relative to the turntable 38. The stand 40 houses a feeler device which scans the angular position of the bracket 41 relative to the turntable 38 in the horizontal plane. This scanning is done by an angle feeler instrument such as e.g. available from the firm Dipl.-Ing. Nicola Krympotic of Hinwil, Switzerland. The output signal of this scanning device is fed to the drive motor 39 and according to the angular position sensed the rotational speed of the drive motor 39 is increased or decreased, respectively, such to be synchronized with the rotational speed of the circular knitted fabric. Alternatively, the output signal may be fed to the belt drive motor 57 driving the fabric feeding rollers 43 such to decrease or increase their rpm while maintaining the rpm of the turntable drive motor 39 constant. Quite obviously, if an initial twisting has occurred, the rotational speed of the drive motor 39 must initially be operated to be somewhat higher such to untwist the fabric and thence controlled into synchronism with the rotating fabric (or the rotational speed of the belt drive motor 57 initially be operated to be somewhat lower).

It has been mentioned that maintaining continuously and accurately the set width of the band or bands respectively, cut in band cutting machines is a difficult task. The known machines scan the position of the upper edge of the circular knitted fabric and adjust the width of the respective band being cut, in that the upwards feeding movement of the fabric is controlled by the fabric feeding means.

This inventive band cutting machine is provided with a light emitter 93 located immediately under the center of the arm cross and a light receiving photoelectric apparatus 94 mounted here at the under side of arm 5. Such apparatus 94 is a position error detector, e.g. available from the firm Dipl.-Ing. Nicola Krympotic of Hinwil, Switzerland. The light receiving photoelectric apparatus 94 is electrically connected to the drive motor 81 controlling the translatory position of the carrier block 23 of the cutting knives 19, 20. Drive motor 81 is now operated and controlled by mentioned signals such to raise and lower, respectively, the cutting knives 19, 20 (or by other embodiments such portion of the frame which is translatorily moved with the cutting knives) in accordance with any deviation from the set position of the upper edge of the knitted fabric set to have a respective band cut with the desired width. This allows now a much more accurate continuous cutting of a repective band in comparison with hitherto possible band cutting machines.

While there is shown and described the present preferred embodiment of the invention, it is to be distinctly understood that the invention is not limited thereto, but may be otherwise variously embodied and practiced within the scope of the following claims.

We claim:

1. A band cutting machine for cutting a tubular article such to produce at least one band therefrom, said band cutting machine including a frame;

a rotating cutting means supported by said frame and having at least one rotating cutting member intended to cut such tubular article into at least one band and having further a driving means operative to rotate said cutting member;

a rotatably mounted supporting turntable intended to support a supply of a folded or rolled tubular article to be cut;

a drive motor coupled to said supporting turntable and operative to rotate said turntable at a controlled rotational speed;

an article feeding and rotating means operative to continuously feed said tubular article towards said cutting means in a spread out condition by drawing said article off said turntable and simultaneously inducing a horizontal rotary movement of said tubular article whereby said tubular article is fed continuously towards said cutting means;

said cutting means comprising at least one cutting member supporting shaft supported for rotation around its center axis and for a simultaneous controlled translatory longitudinal movement in direction of its center axis relative to at least one section of said frame;

comprising further a control means for controlling the translatory position of said cutting member supporting shaft;

a feeler means operative to scan the position of the upper edge of said rotating tubular article being fed towards said at least one rotating cutting member and to transmit a control signal indicative of the position of said upper edge of the tubular article to said cutting member supporting shaft position control means;

whereby the translatory position of said at least one cutting member relative to said at least one section of the frame is continuously adjusted in accordance with the scanned position of said upper edge of said tubular article such to maintain a continuously and accurately determined width of a respective band being cut;

said rotating article supporting turntable comprising a tubular article position feeler means mounted thereupon and operative to determine the angular position of the article being rotatively drawn off said turntable relative to the angular position of said turntable and to transmit a control signal indicative of said relative angular position;

whereby upon a first relative angular position of said tubular article being drawn off said turntable relative to said turntable in a first sense of rotation exceeding a first preset value and thus indicative of said rotating tubular article leading said turntable, the rotational speed of said turntable relative to the rotational speed of the rotary movement of said tubular article is increased and upon a second relative angular position of said tubular article relative to said turntable in a second, opposite sense of rotation exceeding a second preset value and thus indicative of said rotating tubular article trailing said turntable, the rotational speed of said turntable relative to the speed of the rotary movement of said tubular article is decreased.

2. The band cutting machine of claim 1 wherein said at least one cutting member supporting shaft is rotatably supported in a carrier block which is supported and guided by a guiding means mounted to said at least one section of said frame for said movement in the axial direction of said at least one cutting member supporting shaft, wherein said cutting member supporting shaft position control means comprises a drive motor mounted to said at least one section of said frame and comprises further a carrier block positioning means driven by said drive motor and operatively connected to said carrier block, and wherein said feeler means comprises a photoelectric device connected electrically to said drive motor for transmitting said control signal indicative of the position of said upper edge of said tubular article thereto whereby the motor is actuated if said position deviates from a preset value.

3. The band cutting machine of claim 2, wherein said guiding means for said carrier block comprise at least one upright shaft mounted to said at least one section of said frame and a sliding ball bearing supporting said carrier block against said upright shaft, and wherein said carrier block positioning means comprises a rolling nut type gear device, of which the shaft is driven by said drive motor and the nut member is mounted to said carrier block.

4. The band cutting machine of claim 2, wherein said guiding means for said carrier block comprises at least one upright shaft mounted to said at least one section of said frame and a sliding ball bearing supporting said carrier block against said upright shaft, and wherein said carrier block positioning means comprises a linear drive unit having a frictionless nut, of which the shaft is driven by said drive motor and the frictionless nut is mounted to said carrier block.

5. The band cutting machine of claim 1, wherein there is provided a belt drive and said at least one cutting member supporting shaft is rotated by a belt pulley, which belt pulley is supported by said at least one section of the frame with its center axis coinciding with the respective center axis of said at least one cutting member supporting shaft, and wherein each cutting member supporting shaft extends through its drive pulley in a form closed condition allowing an axial movement of the respective shaft relative to its driving pulley yet a positive rotational drive engagement.

6. The band cutting machine of claim 1, in which said tubular article position feeler means mounted on said turntable comprises a bracket, through which said tubular article drawn off said turntable advances, which bracket is mounted for a limited horizontal rotation on a stand on said turntable, and in which there is provided a feeler scanning the angular deviation of the longitudinal axis of said bracket from a given axis of said turntable, which feeler provides signals indicative of said angular deviation.

7. The band cutting machine of claim 1 in which said frame comprises a set of arms, further in which said article feeding and rotating means comprises a plurality of feeding rollers driven for rotation by a common drive, each feeding roller suspended at one of said arms for a translatory movement therealong, further in which there is provided a further drive for moving said feeding rollers along said arms, whereby said feeding rollers are translatorily movable along said arms such to increase or decrease, respectively, their mutual distance, thus allowing an adjustment of said distance to correspond to the respective inner diameter of various tubular articles.

8. The band cutting machine of claim 7, in which said common drive comprises a motor driven endless belt drive and each feeding roller is provided with a drive pulley driven by said endless belt;

each feeding roller is supported by a sliding block which is slidable along a respective arm;

said drive for moving the feeding rollers along their respective arms comprises a plurality of threaded spindles, each extending along a respective arm and through a respective sliding block, which threaded spindles are interconnected for common rotation, whereby upon a drivingly rotating of one of the spindles all spindles rotate simultaneously thus moving said feeding rollers simultaneously along their respective arms.

9. The band cutting machine of claim 6, in which each feeding roller comprises a stationary central hollow shaft mounted to said sliding block;

a rotatable hollow cylinder extending coaxially to said shaft and driven by a belt drive pulley mounted on the cylinder;

a plurality of shell shaped tubular article feeding segments arranged at the circumference of said rotatable cylinder; and a means for inducing a reciprocating movement of said feeding segments parallel to the longitudinal axis of said rotatable hollow cylinder.

10. The band cutting machine of claim 9, wherein said means for inducing a reciprocating movement of said feeding segments comprises an inclined annular bearing member mounted to and surrounding said stationary hollow shaft and having a circumferential race; a plurality of segment guiding slots located in said rotatable hollow cylinder and extending in the longitudinal direction thereof; guide pin members, one each mounted to a respective shell shaped tubular article feeding segment and projecting through one respective of said slots and into said circumferential race of said inclined bearing;

whereby upon rotation of said rotatable hollow cylinder around said stationary central shaft said guide pin members travel in said circumferential race thus imposing on their respective tubular article feeding segment a reciprocating longitudinal movement relative to the rotating hollow cylinder and accordingly a movement around said stationary central shaft following a Sinus-wave shaped path, the multiple feeding rollers being arranged such that they hold and support a tubular article to be cut in a spread out condition, and such that said tubular article feeding segments contact the tubular article only during their rotating upwards movement corresponding to the rising branch of said Sinus-wave shaped path such that a combined rotary and upwards feeding movement is imparted on said tubular article.

* * * * *